United States Patent [19]

Carter et al.

[11] Patent Number: 4,805,728

[45] Date of Patent: Feb. 21, 1989

[54] SOUND SYSTEM WITH ANECHOIC ENCLOSURE

[76] Inventors: Robert Carter, 9050 Flanders Dr., San Diego, Calif. 92126; Allan Hamilton, 2020 Mark Ave., Escondido, Calif. 92027

[21] Appl. No.: 102,430

[22] Filed: Sep. 29, 1987

[51] Int. Cl.[4] ..... H04R 27/00

[52] U.S. Cl. ..... 181/141; 181/145; 181/146; 181/151; 381/83; 381/91

[58] Field of Search ..... 181/30, 141, 145, 146, 181/148, 151, 175, 199, DIG. 1; 381/82-85, 91

[56] References Cited

U.S. PATENT DOCUMENTS

| | | | |
|---|---|---|---|
| 1,853,286 | 4/1932 | Round et al. | 181/30 X |
| 3,207,257 | 9/1965 | Wilson . | |
| 3,247,926 | 4/1965 | Metros . | |
| 3,301,956 | 1/1967 | Krug et al. . | |
| 3,692,959 | 9/1972 | Lamp . | |
| 3,867,996 | 2/1975 | Lou | 181/148 |
| 3,923,119 | 12/1975 | Frye | 18/0.5 |
| 4,065,647 | 12/1977 | Frye et al. . | |
| 4,088,835 | 5/1978 | Thurmond et al. | 381/83 |
| 4,151,777 | 5/1979 | Sugiyama et al. | 84/1.16 |
| 4,357,499 | 11/1982 | Brüel . | |
| 4,437,189 | 7/1984 | Newman | 381/91 |
| 4,463,453 | 7/1984 | Cohel et al. | 367/135 |
| 4,497,234 | 2/1985 | Strnad | 84/1.04 |

*Primary Examiner*—B. R. Fuller

*Attorney, Agent, or Firm*—Calif Kip Tervo

[57] ABSTRACT

A sound system, for a band or the like, incorporates an anechoic enclosure which allows a performer to use the same desired speaker color under all performing conditions and which insulates the audience and other pick-up microphones from each sound-source's speaker and insulates the pickup microphone for each sound source from the ambient room sounds. According to the system, a sound source, such as a musical instrument, outputs a first sound signal which is amplified and fed to a speaker in an anechoic enclosure. In response to the speaker output, a microphone in the anechoic chamber outputs a second sound signal which is amplified and distributed to room speakers. In its exemplary embodiment, the anechoic enclosure comprises four laminated layers: an inner layer of rigid closed-cell foam surrounding a chamber; a layer of denser flexible, closed-cell foam; a second layer of rigid closed-cell foam; and an outer hard, rigid layer. The enclosure may be opened so that the speaker therein may be heard.

9 Claims, 1 Drawing Sheet

SOUND SYSTEM WITH ANECHOIC ENCLOSURE

BACKGROUND OF THE INVENTION

Field of the Invention

This invention relates in general to sound systems for performing groups and more particularly to a sound system incorporating an anechoic enclosure and to a particular embodiment of an anechoic enclosure.

Background of the Invention

Typically, most members of bands that use sound amplification have personal amplifiers and speakers. For example, a lead guitarist with an electric guitar has an amplifier that receives the sound signals from the guitar and a speaker connected to the amplifier for transforming the amplified sound signals into audible sounds. Typically, also, the amplifier is adjustable such that the sound signals can be modified in various ways, e.g. bass, treble, distortion, etc., so that the sounds emanating from the speaker are the sounds desired by the performer. This sound of the speaker is often referred to as speaker "color". The manner of play, the amplifier and amplifier settings, and the speaker color all contribute to producing a very specific and desired sound. In effect, the instrument, amplifier, and speaker together have become a single instrument. A performer may search long and hard for the combination of play, amplifier, speaker, and settings that produces the desired results. Thereafter, this is the combination and speaker color that the performer always hears while practicing.

For the most part, performers are nomadic and must play in many locations, different types of facilities, and with various other performers and instrument types. Because of this, it is often desirable to alter the volume of the performer's speaker. However, this affects the color and it would be desirable to have a means allowing a performer to use the same speaker color under all performing conditions from a small room or recording studio to a large auditorium or outdoor amphitheater.

Also, problems arise when performing over a public address (PA) system. Typically, a pick-up microphone (mike) is disposed in front of each performer's speaker and the mike output is fed to a mixing board, amplified, and then to the large PA speakers. Because the performers cannot hear the large PA speakers well, a smaller PA system speaker, called a monitor, is disposed adjacent each performer. Consequently, a pick-up mike receives not only the sound from its performer's personal speaker directly but also sound from other sources including sound from the performer's speaker as it reflects in the performing room, sound from other performers' speakers, sound from the monitors, sounds from the audience, and sound from the large PA speakers. It is desirable to eliminate these other sound inputs to the pick-up mike, particularly the feedback sounds.

SUMMARY OF THE INVENTION

According to the invention, a sound system for a performer, such as an electric guitar player, comprises: a sound source, such as the electric guitar, for producing a first sound signal; a first amplifier for receiving the first sound signal and for producing an amplified sound signal in response thereto; and a first speaker connected to and driven by the first amplifier. A microphone receives the first speaker output and produces a second sound signal. A second amplifier connected to the microphone drives a second speaker in response to the second sound signal. The first speaker and the microphone are housed in an anechoic enclosure such that the microphone detects only the sound output of the first speaker and is not influenced by conditions external to the enclosure.

A exemplary embodiment of the anechoic chamber includes at least three laminated layers. An inner layer of rigid closed-cell foam has an inner wall which surrounds and defines an inner air filled chamber. A layer of flexible closed-cell is laminated to the outside of the inner layer. The flexible foam is more dense than the inner layer. A hard, rigid outer layer is disposed outside of the other layers. The layers are substantially attached to one another over their entire adjacent surfaces. A speaker support, with attached speaker, traverses the inner chamber and divides it into a front chamber in front of the speaker and a rear chamber behind the speaker. A speaker wire conducts the sound signal from external said enclosure to the speaker. A microphone is mounted within inner chamber and connected wire sends conducts the microphone signal external to the enclosure. A vent between the front and rear chambers allows air to pass therebetween for obtaining equal pressure.

Other features and many attendant advantages of the invention will become more apparent upon a reading of the following detailed description together with the drawing, wherein like reference numerals refer to like arts throughout.

DETAILED DESCRIPTION OF THE INVENTION

Figure 1:
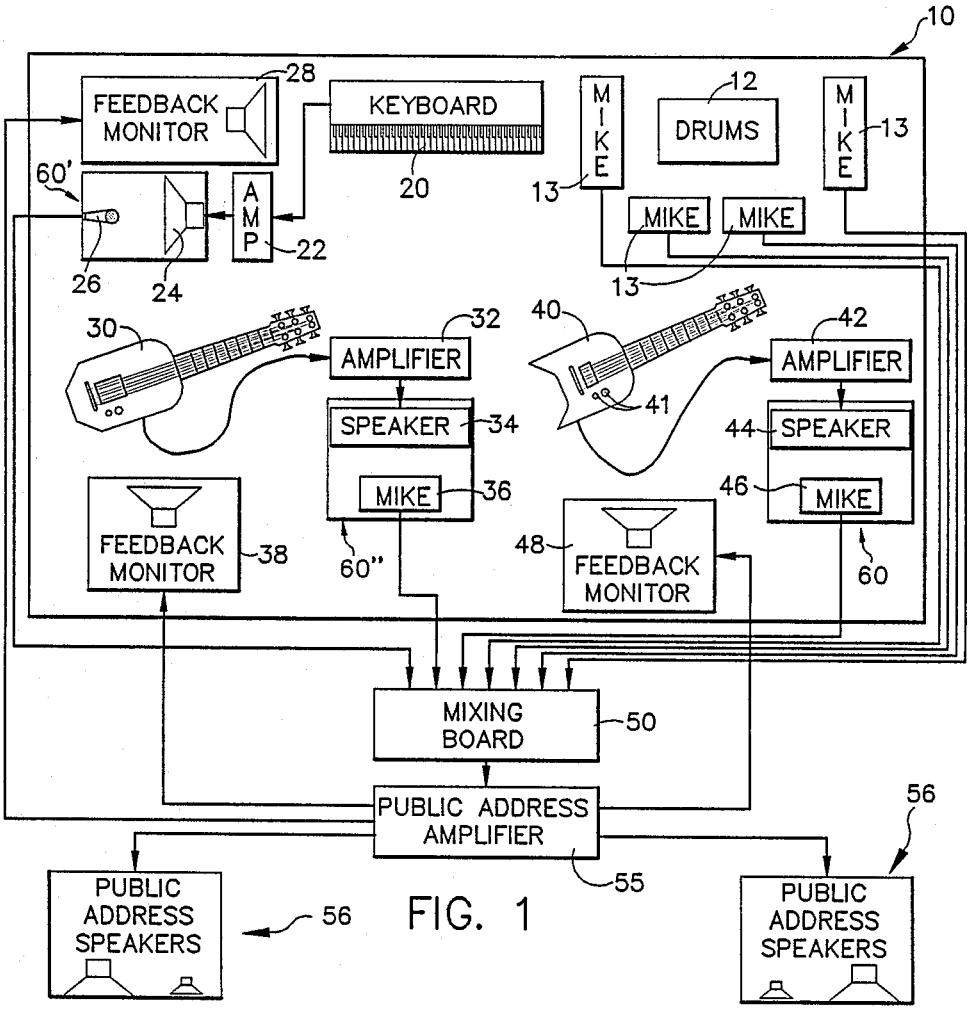
FIG. 1 is a block diagram of the sound system of the present invention.

With reference now to the drawing, and more particularly to FIG. 1 thereof, there is shown, in block diagram form, a portion of a typical sound system for a band; the sound system incorporating the device of the instant invention. The band members and their instruments are typically presented on a stage or bandstand, denoted generally as 10. Four instruments are depicted: drums 12, keyboard 20, rhythm guitar 30, and lead guitar 40. Of course, other instruments, including the human voice, may be incorporated as desired into the system of the present invention.

The lead guitar 40 (electric) is connected to amplifier 42 which drives speaker 44. Various adjustment means 41 on the lead guitar 40 and on the amplifier 42 allow the performer to manipulate the guitar and amplifier output such that a desired speaker sound ("color") is obtained.

Lead guitar pickup mike 46 is connected to mixing board 50. Mixing board 50 is connected to public address (PA) amplifier 55, which is connected to and drives the public address speakers, denoted generally as 56. Mixing board 50 and PA amplifier 55 are generally located in the middle of the audience or toward the rear of the audience section. A sound technician sitting at the mixing board 50 and PA amplifier 55 can adjust the mixing board settings and the PA amplifier settings so that the desired band sound reaches the audience. These setting may vary according to many factors including the acoustic properties of the auditorium, the size of the audience, and the composition being performed.

Lead guitar feedback monitor 48 is a speaker connected to PA amplifier 55 and disposed near the lead guitarist. The output of monitor 48 is typically the same as that of the PA speakers. Monitor 48 lets the guitarist hear directly his performance or, more typically, the performance of the band.

The sound system for keyboard 20 includes amplifier 22, speaker 24, pickup mike 26, and monitor 28. The sound system for rhythm guitar is similar, and includes amplifier 32, speaker 34, pickup mike 36, and monitor 38.

Some instruments, because of their nature, do not have their own amplifier and speaker. For example, the drums 12 are instead surrounded by a plurality of mikes 13; one for each major drum group.

An anechoic enclosure, denoted generally as 60, houses lead guitar speaker 44 and pickup mike 46. A more detailed description of a specific embodiment of anechoic enclosure 60 is provided below. Anechoic enclosure 60 insulates the instrument speaker and pickup mike from outside sounds so there no undesired feedback into this input mike. Anechoic enclosure 60 retains the sounds of the instrument speaker so that these sounds do not reach the audience or impinge on other mikes, such as drum mikes 13. Anechoic enclosure 60 provides a substantially true output of the speaker to its pickup mike. Thus, the use of anechoic enclosure 60 prevents many of the undesired inputs and feedbacks of a conventional sound system without such enclosures.

The speaker and pickup mike for keyboard 20 and rhythm guitar 30 are also housed in anechoic chambers 60' and 60'', respectively.

Figure 2:
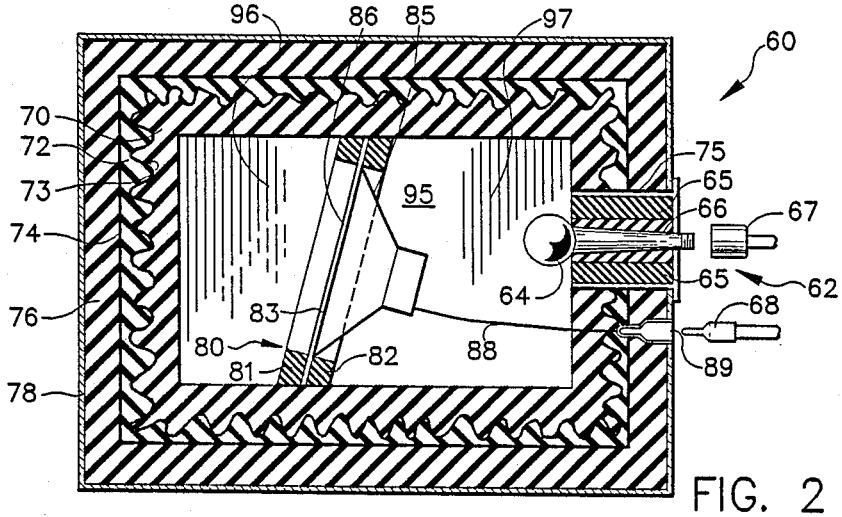
FIG. 2 is a top sectional view of an exemplary embodiment of the anechoic enclosure of the sound system of FIG. 1.

FIG. 2 is a top sectional view of an exemplary embodiment of an anechoic enclosure 60 for use in the sound system illustrated in FIG. 1. Dimensions are given for illustrative purposes and are from a prototype enclosure. Latest test results indicate that a much smaller and lighter enclosure using these materials will produce similar results.

Four laminated layers of sound insulating materials, 70, 74, 76, 78, surround and define an inner air-filled chamber 95. The layers are secured to one another, such as by gluing with a rubber cement, over substantially their entire adjoining surfaces. In the exemplary embodiment, inner layer 70 is a rigid, closed-cell foam such as two inch thick urethane having a density of one and one-half pounds per cubic foot. Inner layer 70 surrounds and defines an inner, air-filled chamber 95.

A layer of flexible closed-cell foam 72 surrounds and is laminated to inner layer 70. An elastomer rubber is ideal as flexible layer 72. Flexible layer 72 has an inner side 73 which is very rough and acts to disperse and otherwise attenuate the sound waves. Flexible layer outer side 74 is smooth.

Surrounding and laminated to flexible layer 72 is a second layer of rigid closed-cell foam 76 similar to inner layer 70. Second layer 76 supports flexible layer 72 and provides additional sound attenuation.

Hard rigid outer shell 78 surrounds and is laminated to the outer foam layer. In the exemplary embodiment, outer shell 78 is made of one-quarter inch thick delimar plastic. It is very dense and has smooth inner and outer surfaces.

Speaker support 80 traverses inner chamber 95 and supports speaker 85, which in the exemplary embodiment is a twelve inch speaker. Speaker 85 has a front 86 and a rear 87. Speaker support 80 divides inner chamber 95 into a front chamber 96 in front of the speaker and a rear chamber 97 behind the speaker. In the exemplary embodiment, speaker support 80 is comprised of two layers of rigid closed-cell foam 81,82, similar to the layers 70,76, laminated outside a denser rigid member 83, such as quarter inch thick particle board. Sound signal receiving means such as wire 88 and jack 89 connect speaker 85 to sound sources external to the chamber.

Vent means (not shown) external to speaker 85 pass between front and rear chambers 96,97 and allow air to pass therebetween. The vent means is of just sufficient size for equalizing the pressure in chambers 96,97 when the speaker is being driven. The area of the vent means is proportional to the speaker size.

Microphone support means, such as mike plug 62, fits snuggly in a bore 75 thru the laminated layers and is removable to provide ease of placement of microphone 64 in a desired pickup location in inner chamber 95 where it will receive and transmit an undistorted reproduction of the sound from the speaker. Mike plug 62 includes sound insulation means 65 which is similar to that of the laminated layers in adjoining enclosure wall, and it is intended that mike plug 62, when in bore 75 and supporting mike 64, preserve the anechoic character of the enclosure 60 and there are no openings for sound to enter or escape from inner chamber 95. Although Mike plug 62 is illustrated as having the same thickness as the enclosure wall, it may extend into chamber 95 and support mike 64 at a location away from the adjoining inner wall of the enclosure. Mike plug 64 provides a means for easy insertion and retention of mike 64. Also, although in the illustration the stem of mike 64 extends thru a central bore 66 in mike plug 64 where it can be connected to wire 67 going to the mixing board, other structures are contemplated, and all of mike 64 may be within enclosure 60 with only connect cable 67 passing thru the enclosure wall.

From the foregoing description, it is seen that the sound system of the present invention allows a performer to use the same speaker color under all performing conditions. Also, it is seen that the sound system of the present invention eliminates undesired sound inputs while providing for a continuation of the conventional manner of practice.

Although a particular embodiment of the anechoic chamber utilized on the sound system has been illustrated and described, various changes may be made in the form, construction, and arrangement of the parts herein, without sacrificing any of its advantages, and it is to be understood that all matter herein is to be interpreted as illustrative and not in any limiting sense. It is intended to cover in the appended claims such modifications and changes as come within the true spirit and scope of the invention.

We claim:

1. A sound system for a musical performer comprising in combination:

a music source for producing a first music signal;

first amplifier means connected to said music source for receiving said first music signal from said music source and for producing a first amplified music signal in response thereto;

an anechoic enclosure having an inner chamber and further including:

a first speaker disposed within said chamber and connected to said first amplifier means for receiving said first amplified music signal and for producing sounds in response thereto; and microphone means disposed within said chamber for receiving the sounds from said first speaker and for producing a second music signal in response thereto;

second amplifier means connected to said microphone means for receiving said second music signal and for producing second amplified signal in response thereto; and second speaker means connected to said second amplifier means for receiving said second amplified signal and for producing musical sounds in response thereto.

2. The sound system of claim 1 wherein said second speaker means includes:

public address speaker means for playing the musical sounds to an audience, and feedback monitor speaker for playing the musical sounds to the performer.

3. A sound system for a musical performance comprising in combination:

a plurality of music sources, each for producing a respective first music signal; and each having a respective:

first amplifier means connected to said music source for receiving said first music signal from said music source and for producing a first amplified music signal in response thereto;

an anechoic enclosure having an inner chamber and further including:

a first speaker disposed within said chamber and connected to said first amplifier means for receiving said first amplified music signal and for producing sounds in response thereto; and microphone means disposed within said chamber for receiving the sounds from said first speaker and for producing a second music signal in response thereto; and mixing and second amplifier means connected to said microphone means for receiving said second music signals, for mixing said second music signals, and for producing a second amplified signal in response thereto; and second speaker means connected to said mixing and second amplifier means for receiving said second amplified signal and for producing musical sounds in response thereto.

4. The sound system of claim 3 wherein said second speaker means includes:

public address speaker means for playing the musical sounds to an audience, and feedback monitor speaker means for playing the musical sounds to a performer.

5. An anechoic enclosure comprising:

at least three laminated layers including:

an inner layer of rigid closed-cell foam having an inner wall surface surrounding and defining an inner air filled chamber and having an outer wall surface;

a layer of flexible closed-cell foam outside of said inner layer having an inner wall surface adjacent said outer wall surface of said inner layer and having an outer wall surface; said flexible foam being more dense than said inner layer; and a hard, rigid outer layer having an inner wall surface adjacent said outer wall surface of said layer of flexible closed-cell foam;

said layers substantially attached to one another over their entire adjacent surfaces;

a speaker support, including speaker means mounted thereupon, traversing said inner chamber and dividing said inner chamber into a front chamber in front of said speaker and a rear chamber behind said speaker; said speaker means including means for receiving a sound signal from external said enclosure; and microphone support means within said inner chamber for supporting a microphone; and vent means between said front and rear chambers for allowing air to pass therebetween for obtaining equal pressure.

6. The enclosure of claim 5 wherein said inner chamber is elongate and has a longitudinal axis and said speaker is mounted such that the axis thereof is at an angle with respect to said longitudinal axis.

7. The enclosure of claim 5 including:

a bore through said laminated layers; and wherein:

said microphone support means includes an insulated plug for supporting a microphone; said plug adapted to fit said bore and preserve the anechoic integrity of said enclosure.

8. The enclosure of claim 7 wherein:

said plug is readily inserted into and removed from said bore such that a supported microphone is easily inserted or removed.

9. An anechoic enclosure comprising:

at least four laminated layers including:

an inner layer of rigid closed-cell foam having an inner wall surface surrounding and defining an inner air filled chamber and having an outer wall surface;

a layer of flexible closed-cell foam outside of said inner layer having an inner wall surface adjacent said outer wall surface of said inner layer and having an outer wall surface; said flexible foam being more dense than said inner layer; and a second layer of rigid closed-cell foam outside of said layer of flexible closed-cell foam having an inner wall surface adjacent said outer wall surface of said flexible cell foam layer and having an outer wall surface;

a hard, rigid outer layer having an inner wall surface adjacent said outer wall surface of said second layer of rigid closed-cell foam;

said layers substantially attached to one another over their entire adjacent surfaces;

a speaker support, including speaker means mounted thereupon, traversing said inner chamber and dividing said inner chamber into a front chamber in front of said speaker and a rear chamber behind said speaker; said speaker means including means for receiving a sound signal from external said enclosure; and microphone support means within said inner chamber for supporting a microphone; and vent means between said front and rear chambers for allowing air to pass therebetween for obtaining equal pressure.

* * * * *